US009334745B2

(12) United States Patent
Miyoshi et al.

(10) Patent No.: US 9,334,745 B2
(45) Date of Patent: May 10, 2016

(54) GAS TURBINE STATOR VANE

(75) Inventors: Ichiro Miyoshi, Mito (JP); Shinichi Higuchi, Hitachinaka (JP); Masami Noda, Hitachinaka (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 686 days.

(21) Appl. No.: 13/455,612

(22) Filed: Apr. 25, 2012

(65) Prior Publication Data

US 2012/0275911 A1 Nov. 1, 2012

(30) Foreign Application Priority Data

Apr. 28, 2011 (JP) ..... 2011-100340

(51) Int. Cl.
*F01D 9/04* (2006.01)
*F01D 5/14* (2006.01)

(52) U.S. Cl.
CPC ..... *F01D 9/041* (2013.01); *F01D 5/143* (2013.01); *F05D 2240/10* (2013.01); *F05D 2240/80* (2013.01); *F05D 2250/184* (2013.01); *F05D 2250/711* (2013.01); *F05D 2250/712* (2013.01)

(58) Field of Classification Search
CPC ..... F01D 5/143; F01D 5/225; F01D 11/001; F01D 11/08; F01D 17/162; F01D 9/041; F04D 29/685; F05B 2240/33; F05D 2240/80; F05D 2250/711; F05D 2250/712; F05D 2240/10; F05D 2250/184
USPC ..... 415/182.1, 183, 185, 191, 208.2, 210.1, 415/211.2, 220, 232, 914
See application file for complete search history.

(56) References Cited

U.S. PATENT DOCUMENTS 2,735,612 A 2/1956 Hausmann
4,420,288 A 12/1983 Bischoff
(Continued)

FOREIGN PATENT DOCUMENTS

EP 2 261 462 A1 12/2010
FR 2 928 174 A1 9/2009
(Continued)

OTHER PUBLICATIONS

Extended European Search Report Dated Oct. 25, 2013 (six (6) pages).
Japanese Office Action with English Translation Dated Jul. 29, 2013 (Five (5) pages).

*Primary Examiner* — Igor Kershteyn
*Assistant Examiner* — Jesse Prager
(74) *Attorney, Agent, or Firm* — Crowell & Moring LLP

(57) ABSTRACT

A gas turbine stator vane is effective for suppressing a secondary flow in a region sandwiched between a suction surface side and a pressure surface side, as well as for suppressing augmentation of a horseshoe-shaped vortex occurring near a leading edge of the vane. The stator vane includes a vane profile portion having a pressure surface concaved to a chord line of the vane, and a suction surface convexed to the chord line; an outer-circumferential end wall positioned at an outer circumferential side of the vane profile portion; and an inner-circumferential end wall positioned at an inner circumferential side of the vane profile portion. An outer-circumferential end wall inner surface that is an inner-circumferential surface of the outer-circumferential end wall has an inward convexed shape and an outward convexed shape, at the suction surface side of the vane profile portion.

5 Claims, 9 Drawing Sheets

(56) References Cited

U.S. PATENT DOCUMENTS

| | | | | |
|---|---|---|---|---|
| 6,126,394 | A | 10/2000 | Matsuda | |
| 6,368,055 | B1 | 4/2002 | Matsuda | |
| 7,625,181 | B2 * | 12/2009 | Matsuda | F01D 9/041 415/191 |
| 2004/0081548 | A1 | 4/2004 | Zess et al. | |
| 2006/0233641 | A1 | 10/2006 | Lee et al. | |
| 2007/0081898 | A1 | 4/2007 | Matsuda et al. | |
| 2007/0258810 | A1 | 11/2007 | Aotsuka et al. | |
| 2008/0107519 | A1 | 5/2008 | Ahmad | |
| 2008/0267772 | A1 * | 10/2008 | Harvey et al. | 415/191 |
| 2008/0310961 | A1 * | 12/2008 | Guemmer | 416/189 |
| 2009/0035130 | A1 | 2/2009 | Sonoda et al. | |
| 2009/0053066 | A1 | 2/2009 | Iida | |
| 2010/0040462 | A1 * | 2/2010 | Praisner et al. | 415/208.1 |
| 2010/0047065 | A1 | 2/2010 | Sakamoto et al. | |
| 2010/0196154 | A1 | 8/2010 | Sakamoto et al. | |
| 2010/0284818 | A1 | 11/2010 | Sakamoto et al. | |
| 2011/0064580 | A1 * | 3/2011 | Barnes | F01D 5/143 416/204 A |
| 2011/0189023 | A1 | 8/2011 | Guimbard et al. | |

FOREIGN PATENT DOCUMENTS

| | | | |
|---|---|---|---|
| GB | 2 281 356 | A | 3/1995 |
| JP | 57-038601 | A | 3/1982 |
| JP | 10-184304 | A | 7/1998 |
| JP | 2004-84539 | A | 3/2004 |
| JP | 2005-133697 | A | 5/2005 |
| JP | 2007-247542 | A | 9/2007 |
| JP | 2009-174330 | A | 8/2009 |
| JP | 2009-191656 | A | 8/2009 |
| JP | 2009-209745 | A | 9/2009 |
| WO | WO 2009/129786 | A1 | 10/2009 |

* cited by examiner

GAS TURBINE STATOR VANE

BACKGROUND OF THE INVENTION

1. Field of the Invention

The present invention relates to a stator vane for a gas turbine.

2. Description of the Related Art

For a vane to which load is heavily applied, a flow of fluid streaming near an end wall of the vane, that is, a secondary flow, at a cross section perpendicular to a main flow of gas, is augmented, irrespective of whether the end wall is positioned at an inner circumferential side of the vane or a casing side of a turbine. The augmentation of the secondary flow reduces a flow rate of the fluid streaming near the end wall, correspondingly increases a flow rate of the fluid streaming in a vicinal region of a mean-diametral section of the vane, and thus further increases the load of the vane. As a result, the increase in vane load is known to induce an increase in total pressure loss.

A method has been proposed which forms end wall surfaces into an axially asymmetrical shape to prevent total pressure loss from increasing at such a vane cascade that is heavily loaded. Axially asymmetrical shaping reduces the total pressure loss at the vane cascade. A vane formed with a curved surface including a pair of surfaces, one convexed with respect to an end wall surface, at a pressure surface side, and one concaved with respect thereto, at a suction surface side, is proposed as an example in U.S. Pat. No. 2,735,612.

SUMMARY OF THE INVENTION

In order to suppress a secondary flow in a region sandwiched between the suction surface side and the pressure surface side, when end wall shapes are defined with a pressure gradient as a guideline, the definitions are conducted so that the shape of an end wall at the pressure surface side becomes a convexed end wall shape and so that the shape of an end wall at the suction surface side becomes a concaved one. This conventional method is expected to be effective for suppressing the secondary flow in the region sandwiched between the pressure surface side and the suction surface side. However, since the guideline described in U.S. Pat. No. 2,735,612 does not serve as a guideline for defining the shape of an end wall positioned near a leading edge of the vane, augmentation of a horseshoe-shaped vortex occurring near the leading edge cannot be suppressed. Thus, the conventional method is ineffective for a vane profile significantly susceptible to the horseshoe-shaped vortex.

The present invention is intended to provide a gas turbine stator vane effective for suppressing a secondary flow in a region sandwiched between a suction surface side and a pressure surface side, as well as for suppressing such augmentation of a horseshoe-shaped vortex occurring near a leading edge of the vane.

The gas turbine stator vane in an aspect of the present invention includes: a vane profile portion having a pressure surface concaved to a chord line of the vane, and a suction surface convexed to the chord line; an outer-circumferential end wall positioned at an outer circumferential side of the vane profile portion; and an inner-circumferential end wall positioned at an inner circumferential side of the vane profile portion. An outer-circumferential end wall inner surface that is an inner-circumferential surface of the outer-circumferential end wall has an inward convexed shape and an outward convexed shape, at the suction surface side of the vane profile portion. A first vertex of the inward convexed shape is positioned near the leading edge of the vane profile portion, and a second vertex of the outward convexed shape is positioned in a neighborhood of an intermediate region between the leading edge of the vane profile portion and a trailing edge thereof.

According to the present invention, the gas turbine stator vane is effective for suppressing the secondary flow in the region sandwiched between the suction surface side and the pressure surface side, as well as for suppressing the augmentation of the horseshoe-shaped vortex occurring near the leading edge of the vane.

DESCRIPTION OF THE PREFERRED EMBODIMENTS

Hereunder, the present invention will be described in detail in accordance with illustrated embodiments.

Figure 6:
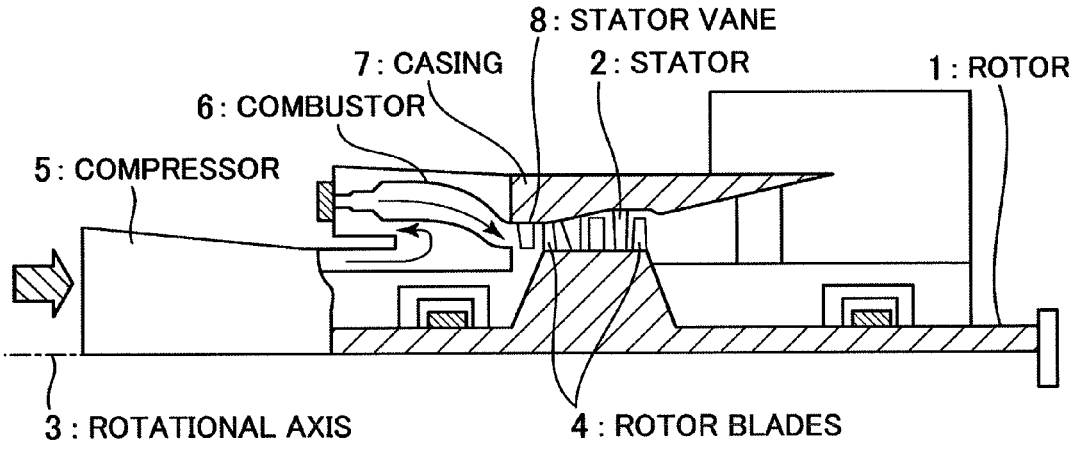
FIG. 6 is a sectional view of the gas turbine.

FIG. 6 shows a sectional view of a gas turbine. A rotor 1 primarily includes a rotating shaft 3, rotor blades 4 arranged on the rotating shaft 3, and rotor blades (not shown) of a compressor 5. A stator 2 primarily includes a casing 7, a combustor 6 supported by the casing 7 and disposed so as to face the rotor blades 4, and stator vanes 8 serving as a nozzle of the combustor 6.

Schematic operation of the gas turbine having the above configuration is described below. First, a fuel and compressed air from the compressor 5 are supplied to the combustor 6, and then the fuel and the compressed air burn to generate a hot gas. The hot gas that has thus been generated is blasted towards each rotor blade 4 via each stator vane 8, thus driving the rotor 1 via the rotor blade 4.

In this case, the rotor blade 4 and stator vane 8 exposed to the hot gas are cooled optionally by a cooling medium. Part of the compressed air from the compressor 5 is used as the cooling medium.

Figure 1:
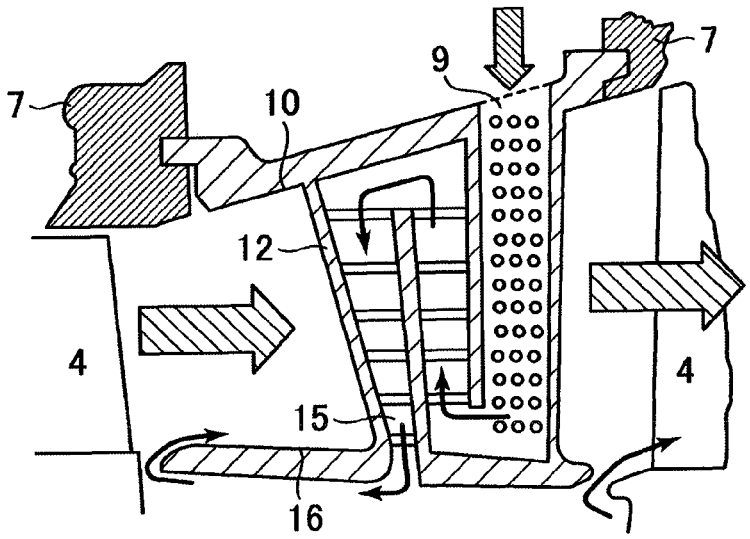
FIG. 1 is an enlarged view showing a stator vane for a gas turbine.

FIG. 1 is an enlarged view showing the stator vane 8. The stator vane 8 includes an outer-circumferential end wall portion mounted on the turbine casing 7 and positioned at an outer circumferential side relative to a rotational axis of the rotor blade 4, that is, at the turbine casing side. The stator vane 8 also includes a vane profile portion 12 that extends from an inner surface 10 of the outer-circumferential end wall portion, in a direction that the vane profile portion 12 decreases in radial position. The stator vane 8 additionally includes an outer surface 16 of the inner-circumferential end wall portion to form a gas flow passageway surface contiguous to a closed surface at which the radius of the vane profile portion becomes a minimum. In addition, the vane profile portion 12 may be constructed with a hollow portion formed therein to supply the cooling medium to the hollow portion and cool the vane from the inside. Referring to FIG. 1, an entrance 9 is that of the cooling medium, and the cooling medium flows in a direction of an arrow to cool the vane profile portion.

The stator vane 8 is installed on the casing 7 which is an outer circumferential wall. The compressor 5 is usually used as a cooling air supply source, and cooling air inlet holes provided in the casing 7 are used to introduce the cooling air into the stator vane 8. The cooling air, after being used for cooling, is discharged from outlet holes 15 provided in an inner circumferential wall, and is eventually discharged into a gas pathway.

Figure 2:
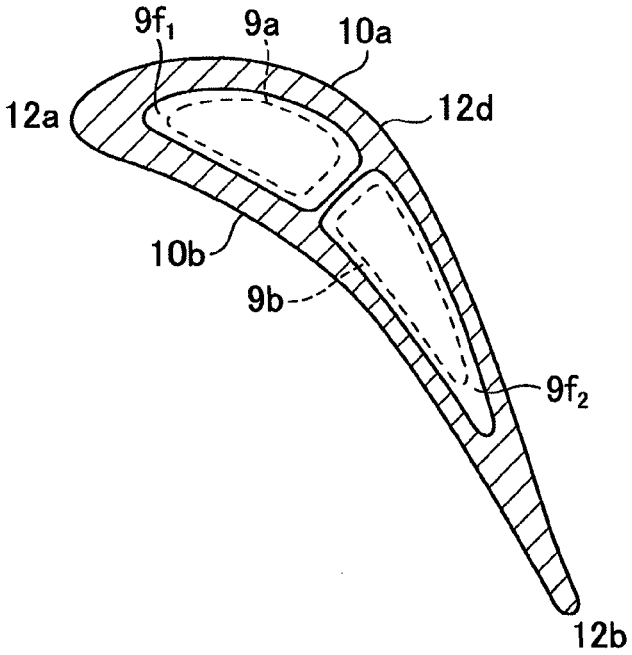
FIG. 2 is a sectional view of a vane profile portion.

FIG. 2 shows a sectional shape of the vane profile portion. The vane profile portion includes a pressure surface 10*b* having a concave shape which is concaved to a chord line of the vane (a chordwise direction of the vane), a suction surface 10*a* having a convex shape which is convexed to the chord line of the vane, a leading edge 12*a* of the vane, and a trailing edge 12*b* of the vane. These elements constitute the vane profile portion formed so that as it goes downward from the leading edge side towards a central side, vane thickness progressively increases, and so that as it goes further downward nearly from the midway towards the trailing edge, vane thickness progressively decreases. In addition, the vane profile portion may be constructed with hollow portions 9*a* and 9*b* formed therein to supply the cooling medium to the hollow portions and cool the vane from the inside. Linear arrows in FIG. 1 denote the flow of the cooling air, and shaded larger horizontal arrows denote the flow of the hot gas, or the main flow of working gas.

Referring to FIG. 2, reference number 12*a* denotes the leading edge, the suction surface 10*a* is a rear, side portion of the vane, the pressure surface 10*b* is a front, side portion of the vane, and reference number 12*b* denotes the trailing edge. The hollow portions 9*a*, 9*b* are chambers for cooling the air that becomes the cooling air described above. In this case, air-cooling chambers $\mathbf{9}f_1$ and $\mathbf{9}f_2$ in a front portion of the vane are finned to improve thermal conversion. As is so discharged after cooling the stator vane in FIG. 1, the cooling air is discharged from the outlet holes in the inner circumferential wall and eventually discharged into the gas pathway. This cooling structure can be convective cooling or other cooling means. Important is the shape of the turbine end wall in which such cooling air becomes entrained.

Figure 3:
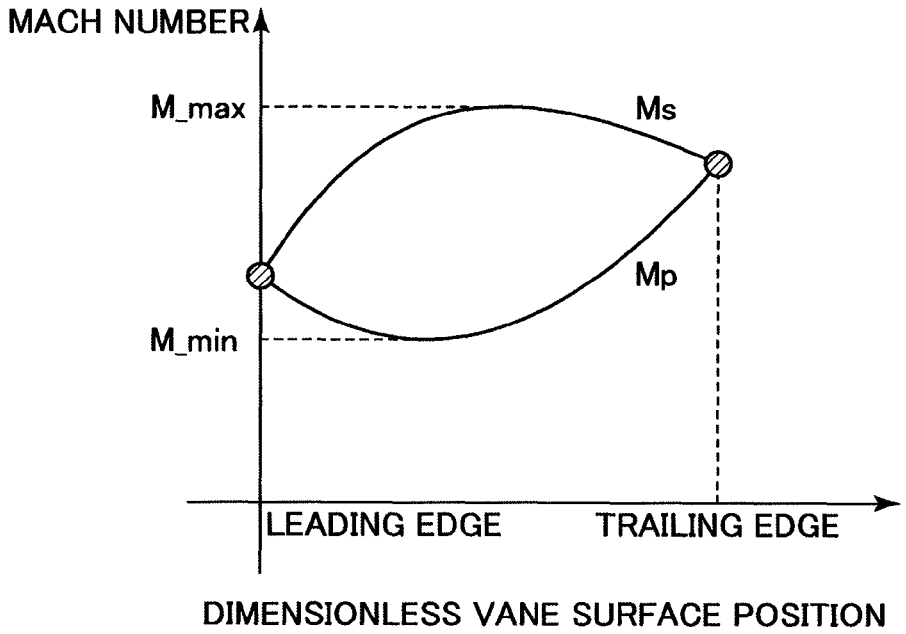
FIG. 3 is an explanatory diagram showing a Mach number distribution of a turbine vane surface.
Figure 4:
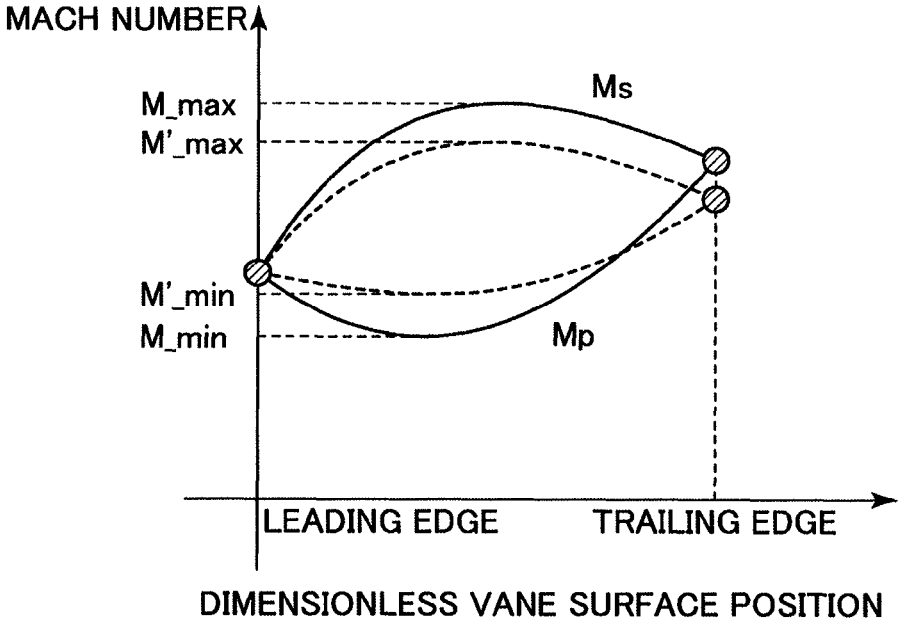
FIG. 4 is another explanatory diagram showing the Mach number distribution of the turbine vane surface.

FIG. 3 is a diagram showing vane-surface Mach numbers of a vane profile in a neighboring region of the inner-circumferential end wall of the turbine stator vane. The vane-surface Mach numbers obtained from the leading edge 12*a* of the suction surface 10*a* of the vane to the trailing edge 12*b*, in the neighborhood of the inner-circumferential end wall, are plotted as "Ms", and the vane-surface Mach numbers obtained from the leading edge 12*a* of the pressure surface 10*b* of the vane to the trailing edge 12*b*, at the inner-circumferential end wall, are plotted as "Mp". As shown in FIG. 3, the vane-surface Mach number on the suction surface 10*a* exhibits a maximum value "M_max" at an intermediate section between the leading and trailing edges of the vane, and significantly decreases at a region from the intermediate section to the trailing edge of the vane. This is because the gas that is the main flow of fluid expands when it streams from an entrance of the vane cascade, formed by the plurality of turbine stator vanes, to an exit of the cascade. In the figure, "M_min" indicates a minimum vane-surface Mach number obtained on the pressure surface 10*b*. An increase in difference between "M_max" and "M_min" means an increase in difference between the maximum pressure and minimum pressure acting upon the vane profile portion, and thus means heavier vane loading.

For a vane to which load is heavily applied, a flow of fluid streaming near an end wall of the vane, that is, a secondary flow, at a cross section perpendicular to a main flow of gas, is augmented, irrespective of whether the end wall is positioned at an inner circumferential side of the vane or a casing side of a turbine. The augmentation of the secondary flow reduces a flow rate of the fluid near the end wall, correspondingly increases a flow rate of the fluid near a section of an average radius, and thus further increases the load of the vane. As a result, the increase in vane load induces an increase in total pressure loss.

A method has been proposed that reforms axially symmetrical end wall surfaces into an axially asymmetrical shape to prevent such an increase in total pressure loss. This conventional method reduces the total pressure loss at the vane cascade. The conventional method features forming a curved surface including a pair of surfaces, one convexed with respect to an end wall surface, at a pressure surface side, and one concaved with respect thereto, at a suction surface side.

Figure 5:
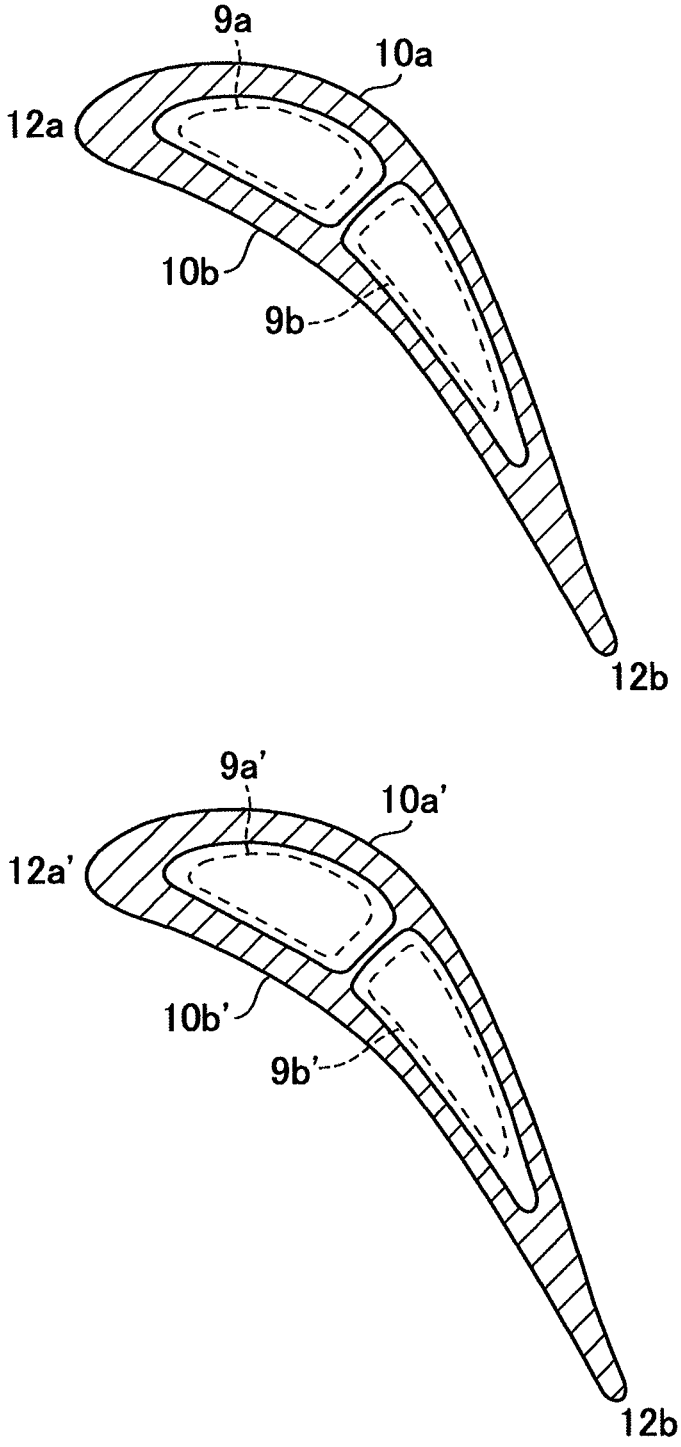
FIG. 5 is a sectional view of a gas turbine stator vane cascade.

FIG. 5 shows a turbine stator vane cascade. In order to suppress a secondary flow in a region sandwiched between a suction surface 10*a*' and pressure surface 10*b* of the stator vanes 8 arranged in a circumferential direction, shapes of end walls can be defined focusing attention upon a pressure gradient as a guideline for reshaping the end walls. If the end wall shapes are defined based on this guideline, the shape of the end wall closer to the pressure surface 10*b* will be determined so as to become a convexed end wall shape, and the shape of the end wall closer to a suction surface 10*a* will be determined so as to become a concaved one. This conventional method is effective for suppressing the secondary flow in the region sandwiched between the pressure surface 10*b* and the suction surface 10*a*. However, the guideline of interest does not serve as a guideline for defining the shape of an end wall positioned near a leading edge 12*a*, augmentation of a horseshoe-shaped vortex originating from the leading edge 12*a* cannot be suppressed. Thus, the conventional method is only slightly effective for a vane profile significantly susceptible to the horseshoe-shaped vortex.

In addition, entry of cooling air from an upstream hub side of such a vane profile further lessens the differential pressure between the entrance and exit at the hub 9, hence further slowing down the main flow of fluid. This slowdown results in further increased total pressure loss at the vane cross section of the hub 9.

The following describes embodiments of a turbine stator vane effective for suppressing a secondary flow in a region sandwiched between a suction surface 10*a*' and a pressure surface 10*b*, as well as for suppressing augmentation of a horseshoe-shaped vortex occurring near a leading edge 12*a*.

First Embodiment

Figure 7:
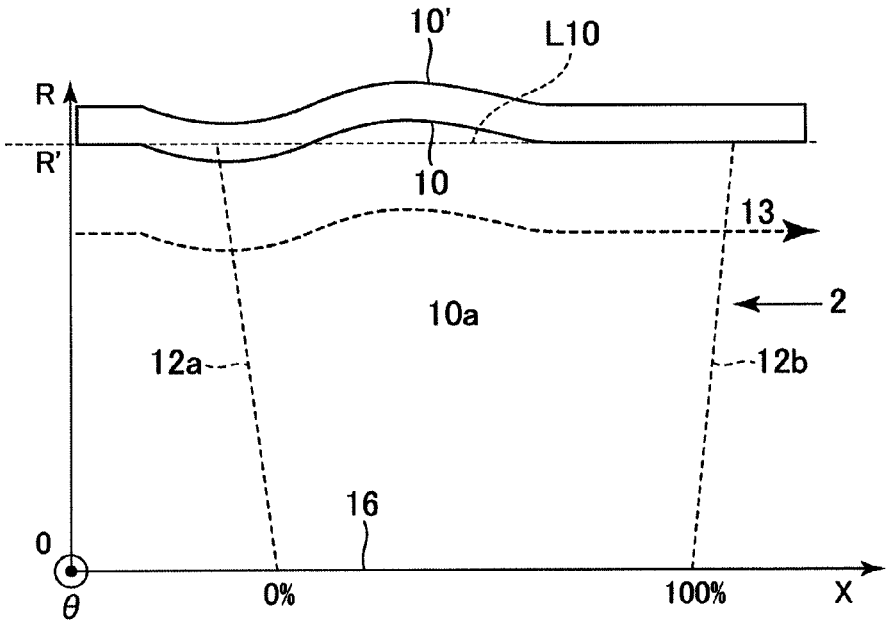
FIG. 7 is an explanatory diagram showing a turbine stator vane according to a first embodiment.

Attention is focused upon the stator vane 8 shown in FIG. 6. FIG. 7 shows a turbine stator vane 8 according to an embodiment of the present invention, with a suction surface of a vane profile portion 12 being specifically shown in perspective view. Arrow 13 denotes a direction in which a gas flows, with a leading edge 12*a* being present at an upstream side and a trailing edge 12*b* being present at a downstream side. Symbol R in FIG. 7 is a coordinate axis that denotes radial positions. An outer-circumferential end wall is positioned at an outer circumferential side of the vane profile portion 12, and an inner-circumferential end wall is positioned at an inner circumferential side of the vane profile portion 12. An outer-circumferential end wall inner surface 10 that is an inner-circumferential surface of the outer-circumferential end wall has an inward convexed shape and an outward concaved shape, at the suction surface side of the vane profile portion 12. The outer circumferential side of the vane profile portion here means a side that is more distant from a rotor 1 when viewed from the vane profile portion 12 with the stator vane 8 mounted in the gas turbine, and the inner circumferential side means a side closer to the rotor 1. Additionally, "outer" means the outer circumferential side, and "inner" means the inner circumference side. The two convexed sections need only to be present on the surface 10 of the end wall, and advantageous effects substantially of the same kind can be obtained, irrespective of whether the convexed sections are in contact with the vane profile portion.

The stator vane 8 of the present embodiment is formed so that the inward convexed shape at the suction surface side has a vertex which positions in the neighborhood of the leading edge. More specifically, the stator vane 8 is formed so that if the leading edge of the vane profile portion that is in contact with the outer-circumferential end wall inner surface 10 is represented as existing at a position of 0%, and the trailing edge as existing at a position of 100% on a straight line L10, then the vertex of the inward convexed shape is positioned in a range from −10% to 40% with reference to the straight line L10. In this case, the straight line L10 passes through a first contact point between the outer-circumferential end wall inner surface 10 and the leading edge of the vane profile portion, and a second contact point between the outer-circumferential end wall inner surface 10 and the trailing edge of the vane profile portion. It is to be noted that the vertex of the inward convexed shape does not need to be positioned on the straight line L10, and a foot of a perpendicular which is drawn from the vertex of the inward convexed shape to the straight line L10 needs only to be positioned in the above-mentioned range. This positioning was derived with attention focused upon the fact that if the range from −10% to 40% is overstepped, this is likely to cause a vortex due to abrupt fluid slowdown in a region neighboring the leading edge of the stator vane 8. That is to say, the above positioning prevents the vortex from occurring. Forming the portion of the outer-circumferential end wall inner surface 10 that neighbors the leading edge, into the inward convexed shape, enhances a velocity of the fluid and thus suppresses the slowdown thereof. This beneficial effect comes from the fact that narrowing the flow passageway by forming the end wall portion into the inward convexed shape enables the velocity to be abruptly increased for suppressing occurrence of the vortex. If the vertex of the inward convexed shape is positioned in a range less than −10% or in excess of 40%, this will reduce an effect that suppresses problems due to the occurrence of the vortex in the vicinity of the leading edge.

The stator vane 8 of the present embodiment is also formed so that the outward convexed shape at the suction surface side has a vertex in a neighborhood of an intermediate region between the leading edge and the trailing edge. More specifically, the stator vane 8 is formed so that the vertex of the outward convexed shape is positioned in a range from 30% to 80% with reference to the straight line L10. It is to be noted that the vertex of the outward convexed shape does not need to be positioned on the straight line L10, and a foot of a perpendicular which is drawn from the vertex of the outward convexed shape to the straight line L10 needs only to be positioned in the above-mentioned range. This region makes it easy for the velocity to abruptly increase and thus for the vortex to occur. Forming the outward convexed shape reduces the velocity and suppresses the abrupt increase in velocity. If the vertex of the outward convexed shape is positioned in a range less than 30%, consequent narrowing of the outward convexed region will reduce a velocity control rate, resulting in the secondary flow suppression effect decreasing. Conversely, if the vertex is present in a range exceeding 80%, an abrupt velocity increase at a downstream side of the outward convexed region will occur, deteriorating vane cascade performance due to a resulting impulse wave loss.

Construction of the section at which the vane profile portion 12 and the end wall portion come into contact is described below. A rounded region with a radius of curvature, R, exists on this contact section. In other words, the end wall portion and the vane profile portion 12 do not perpendicularly intersect with each other. Magnitude of the radius of curvature, R, however, is ignored during a design phase. In the present embodiment, while points from 0% to 100% are set up with a reference point placed on a contact point between the outer-circumferential end wall inner surface 10 and the vane profile portion 12, it is to be understood that this contact point means a design-associated contact point and does not allow for the radius of curvature, R.

The following describes in detail the specific values mentioned above as to the neighborhood of the leading edge and that of the intermediate region between the leading edge and the trailing edge. If the vertex of the inward convexed shape exceeds the position of 40%, a maximum amount of convexing of the convexed region contiguous to the downstream side will be substantially equal to the radius of curvature, R, provided on the vane profile portion and the end wall, and the beneficial effect of the convexed region will consequently decrease to a negligible level. For this reason, the region of the inward convexed shape lies in the range of less than or equal to 40%. On the other hand, if the vertex of the outward inward convexed shape lowers below the position of 30% and a maximum amount of convexing of the inward convexed region at an upstream side increases above 80%, a maximum amount of convexing of the outward convexed region will be substantially equal to the radius of curvature, R. In order to avoid this, the region of the outward convexed shape lies in the range from 30% to 80%.

As described above, in the vicinity of the suction portion of the outer-circumferential end wall inner surface 10 which is the end wall close to the turbine casing 7, the stator vane 8 of the present embodiment is constructed to form the inward convexed shape by lowering a radial position of the vane progressively from the upstream side relative to the flow of the gas, and to form the outward convexed shape by elevating the radial position progressively as it goes downstream from there. Forming the stator vane 8 into such a geometry is effective for suppressing abrupt acceleration and deceleration of the flow in the main flow direction indicated by arrow 13, and the suppression in turn leads to making the velocity gently change, and hence to supplying more suitable stator vane 8. The convexed sections need only to be present on the end wall, and advantageous effects substantially of the same kind can be obtained, irrespective of whether the convexed sections are in contact with the vane profile portion 12.

In the thus-constructed gas turbine, the main flow of fluid that has streamed in towards the turbine stator vane 8 next streams in from the leading edge 12*a* of the vane, then streams along the vane profile portion, and streams out from the trailing edge 12*b* of the vane. Since these end wall shapes suppress a secondary flow, the slowdown of the main flow of fluid streaming along the suction surface 10*a* of the vane profile portion will be suppressed near the outer-circumferential end wall and a decrease in Mach number at the vane cross section of the profile suction surface 10*a* of the stator vane 8 will also be suppressed. Reduction in total pressure loss will be consequently achieved at the cross section of the profile suction surface 10*a* of the stator vane 8. In addition, an increase in total pressure loss at the vane cross section will be suppressed, even under a high aerodynamic load and even when a cooling medium entrained changes in flow rate.

The outer-circumferential end wall inner surface 10 forms a gas flow passageway surface. An outer-circumferential end wall outer surface 10' paired with the outer-circumferential end wall inner surface 10 exists at the outer circumferential side of the end wall. Outer-circumferential end wall thickness that is equal to a distance between the outer-circumferential end wall outer surface 10' and the outer-circumferential end wall inner surface 10 can be either definite or indefinite.

Second Embodiment

Figure 8:
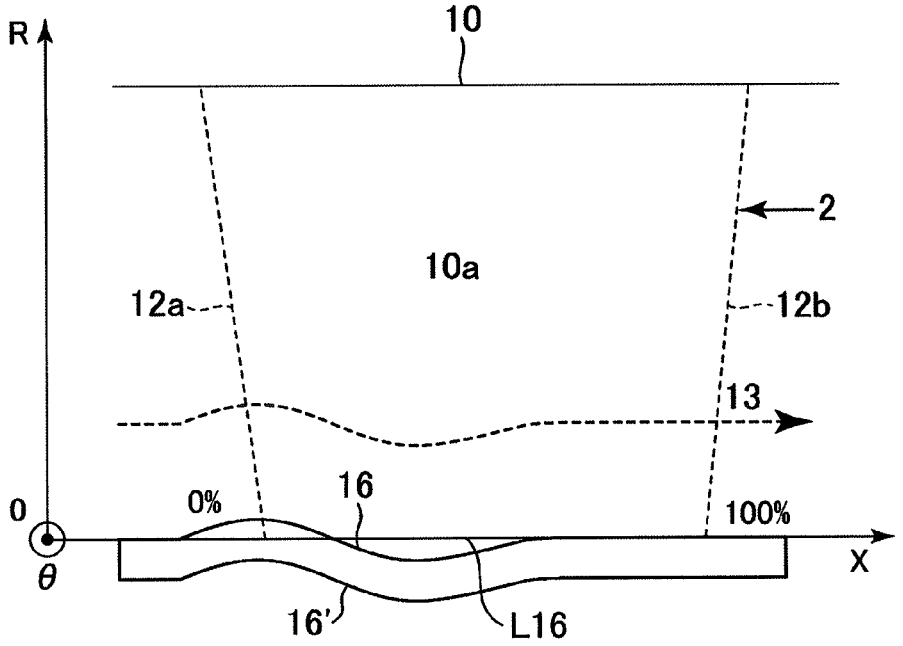
FIG. 8 is an explanatory diagram showing a turbine stator vane according to a second embodiment.

FIG. 8 is a perspective view showing a suction surface 10*a* of a vane profile portion of a turbine stator vane 8 based on a second embodiment of the present invention. Substantially the same elements as in FIG. 7 are omitted and only differences are described. An inner-circumferential end wall outer surface 16 that is an outer circumferential surface of an inner-circumferential end wall has an outward convexed shape and an inward convexed shape, at a suction surface side of the vane profile portion 12.

The stator vane 8 of the present embodiment is formed so that the outward convexed shape at the suction surface side has a vertex at a position neighboring a leading edge. More specifically, the stator vane 8 is formed so that if the leading edge of the vane profile portion that is in contact with the inner-circumferential end wall outer surface 16 is represented as existing at a position of 0%, and the trailing edge as existing at a position of 100% on a straight line L16, then a vertex of the outward convexed shape is positioned in a range from −10% to 40% with reference to the straight line L16. In this case, the straight line L16 passes through a first contact point between the inner-circumferential end wall outer surface 16 and the leading edge of the vane profile portion, and a second contact point between the inner-circumferential end wall outer surface 16 and the trailing edge of the vane profile portion. It is to be noted that the vertex of the outward convexed shape does not need to be positioned on the straight line L16, and a foot of a perpendicular which is drawn from the vertex of the outward convexed shape to the straight line L16 needs only to be positioned in the above-mentioned range. This positioning was derived with attention focused upon the fact that if the range from −10% to 40% is overstepped, this is likely to cause a vortex due to abrupt fluid slowdown in a region neighboring the leading edge of the stator vane 8. That is to say, the above positioning prevents the vortex from occurring. Forming the portion of the inner-circumferential end wall outer surface 16 that neighbors the leading edge, into the outward convexed shape, enhances a velocity of the fluid and thus suppresses fluid slowdown. This beneficial effect comes from the fact that narrowing a flow passageway by forming the end wall portion into the outward convexed shape enables the velocity to be abruptly increased for suppressing occurrence of the vortex. If the vertex of the outward convexed shape is positioned in a range less than −10% or in excess of 40%, this will reduce an effect that suppresses problems due to the occurrence of the vortex in the vicinity of the leading edge.

The stator vane 8 of the present embodiment is also formed so that the inward convexed shape at the suction surface side has a vertex at a position neighboring an intermediate region between the leading edge and the trailing edge. More specifically, the stator vane 8 is formed so that the vertex of the inward convexed shape is positioned in a range from 30% to 80% with reference to the straight line L16. It is to be noted that the vertex of the inward convexed shape does not need to be positioned on the straight line L16, and a foot of a perpendicular which is drawn from the vertex of the inward convexed shape to the line L16 needs only to be positioned in the above-mentioned range. This region makes it easy for the velocity to abruptly increase and thus for the vortex to occur. Forming the inward convexed shape reduces the velocity and suppresses the abrupt increase in velocity. If the vertex of the inward convexed shape is positioned in a range less than 30%, consequent narrowing of the inward convexed region will reduce a velocity control rate, resulting in a secondary flow suppression effect decreasing. Conversely, if the vertex is present in a range exceeding 80%, an abrupt velocity increase at a downstream side of the inward convexed region will occur, deteriorating vane cascade performance due to a resulting impulse wave loss. In accordance with aerodynamic design conditions of the turbine to be designed, the vertex positions of the outward convexed shape and inward convexed shape at the suction surface side are selectively optimized in the above conditions so that abrupt acceleration and deceleration of the flow in a main flow direction indicated by arrow 13 are suppressed for a gentle change in velocity.

The following describes in detail the specific values mentioned above as to the neighborhood of the leading edge and that of the intermediate region between the leading edge and the trailing edge. If the vertex of the outward convexed shape exceeds the position of 40%, a maximum amount of convexing of the convexed region contiguous to a downstream side will be substantially equal to a radius of curvature, R, provided on the vane profile portion and the end wall, and the beneficial effect of the convexed region will consequently decrease to a negligible level. For this reason, the region of the outward convexed shape lies in the range of less than or equal to 40%. On the other hand, if the vertex of the inward convexed shape lowers below the position of 30% and a maximum amount of convexing of the outward convexed region at an upstream side increases above 80%, a maximum amount of convexing of the inward convexed region will be substantially equal to the radius of curvature, R. In order to avoid this, the region of the inward convexed shape lies in the range between 30% and 80%.

As described above, near a suction portion of the inner-circumferential end wall outer surface 16 which is an end wall close to the rotor 1, the stator vane 8 of the present embodiment is constructed to form the outward convexed shape by elevating a radial position of the vane progressively from the upstream side relative to the flow of the gas, and to form the inward convexed shape by lowering the radial position progressively as it goes downstream from there.

In the thus-constructed gas turbine, the main flow of fluid that has streamed in towards the turbine stator vane 8 next streams in from the leading edge 12*a* of the vane, then streams along the vane profile portion 12, and streams out from the trailing edge 12*b* of the vane. Since the outward convexed region and the inward convexed region are set up in the direction of the flow in the above region, a gentle change in velocity is obtained and secondary flow loss is suppressed. This reduces total pressure loss at a cross section of a hub of the profile 12.

The inner-circumferential end wall outer surface 16 forms a gas flow passageway surface. An inner-circumferential end wall inner surface 16' paired with the inner-circumferential end wall outer surface 16 exists at the inner circumferential side of the end wall. Inner-circumferential end wall thickness that is equal to a distance between the inner-circumferential end wall inner surface 16' and the inner-circumferential end wall outer surface 16 can be either definite or indefinite.

Third Embodiment

Figure 9:
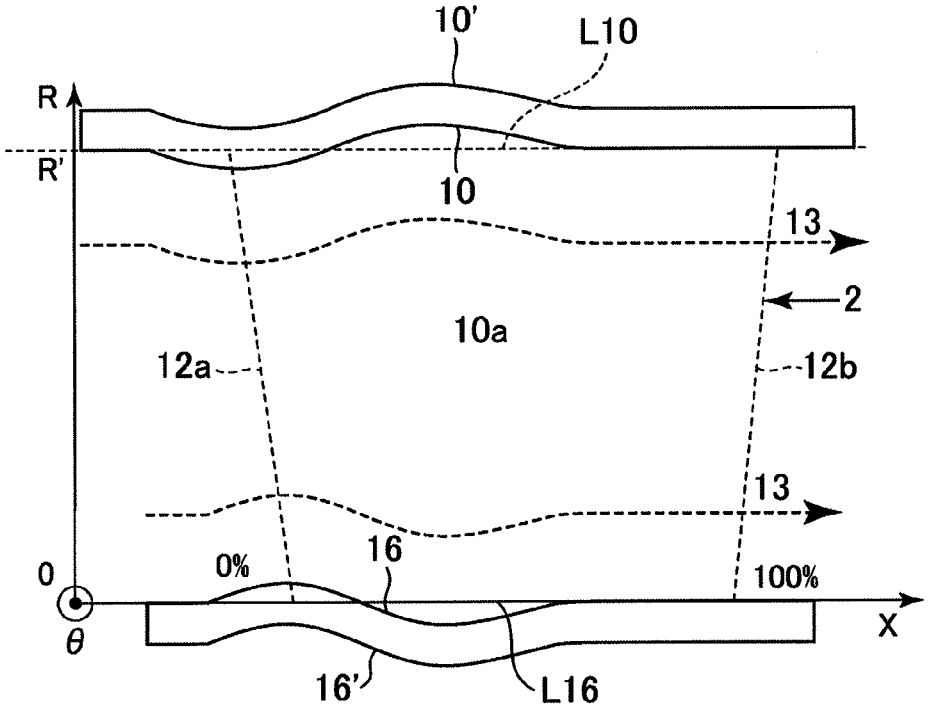
FIG. 9 is an explanatory diagram showing a turbine stator vane according to a third embodiment.

FIG. 9 is a perspective view showing a suction surface of a vane profile portion 12 of a turbine stator vane based on a third embodiment of the present invention. Elements common to those shown in FIGS. 7 and 8 are omitted. The present embodiment is a combination of the first embodiment and the second embodiment. That is to say, the outward convexed shape of the inner-circumferential end wall outer surface 16 of the stator vane 8 according to the first embodiment is positioned in the neighborhood of the leading edge 12*a*, and the vertex of the inward convexed shape of the inner-circumferential end wall outer surface 16 is positioned in the neighborhood of the intermediate region between the leading edge and trailing edge of the vane profile portion 12. The stator vane 8 of the present embodiment enjoys advantages of both embodiments, which leads to supplying an even more suitable stator vane.

Next, FIGS. 10 to 13, showing the stator vanes as viewed from other angles in the respective embodiments, are described below.

Figure 10:
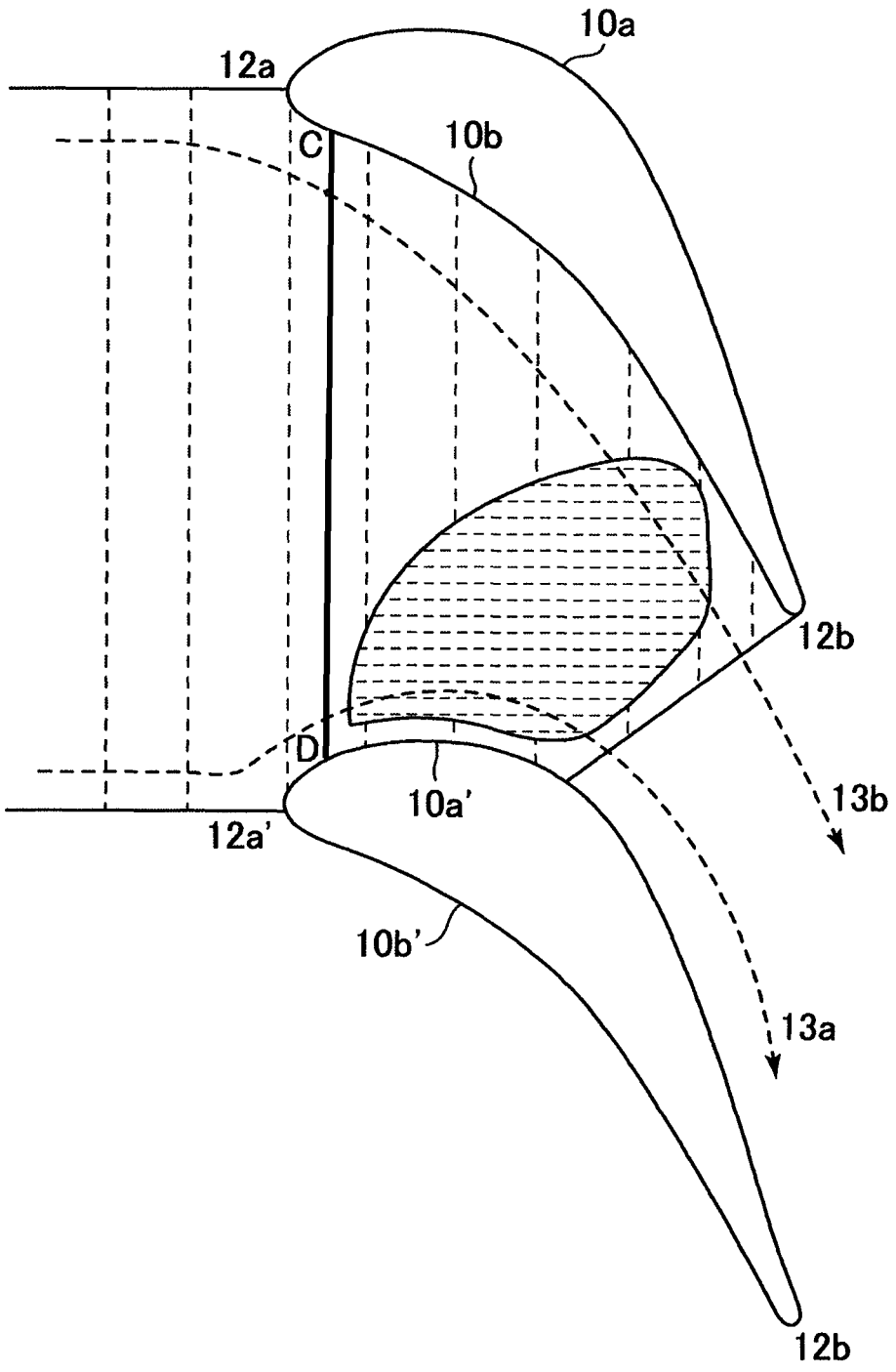
FIG. 10 shows an inner surface of an outer-circumferential end wall portion when viewed from an inner circumferential side.

FIG. 10 shows an outer-circumferential end wall outer surface 10 as viewed from an inner circumferential side. A region denoted by vertically dashed lines is formed to be low in radial position, and a region denoted by horizontally dashed lines is formed to be high in radial position. Reference number 13*a* denotes a flow of fluid at a suction side of an end wall portion close to a casing of the turbine, and reference number 13*b* denotes a flow of fluid at a pressure surface side of the end wall portion close to the turbine casing.

In the flow direction 13*a* at the suction surface side of the outer-circumferential end wall outer surface 10, a shape of the vane profile portion changes from the region of a convexed shape that faces in a direction that a rotor 1 decreases in radial position at a neighboring portion of a leading edge of the vane, to the region of the convexed shape that faces in a direction that the radial position increases. In the flow direction 13*b* at the pressure surface side, the shape of the vane profile portion changes from the region of the convexed shape that faces in a direction that the radial position decreases at the neighboring portion of the leading edge, to the region of the convexed shape that faces in a direction that the radial position increases. It is to be noted that whereas a concave surface and the convex surface are not paired at the pressure surface side and suction side of the end wall portion, in the flow direction the concave surface and the convex surface are paired at both of the suction side and the pressure surface side.

Figure 12:
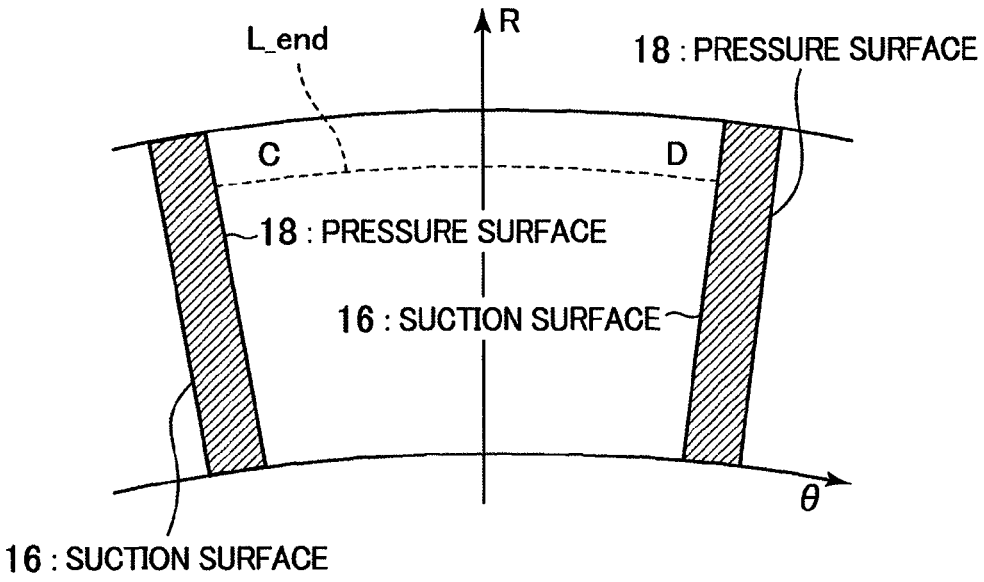
FIG. 12 is a sectional view of a curved surface forming the outer-circumferential end wall inner surface 10 positioned near a leading edge 12*a*, the curved surface being viewed when imaginarily cut along a plane perpendicular to a rotating shaft of the turbine.

FIG. 12 is a sectional view of a curved surface forming the outer-circumferential end wall inner surface 10 positioned near the leading edge 12*a* in FIG. 10, the curved surface being viewed when imaginarily cut along a plane perpendicular to a rotating shaft of the turbine. Let a cross section of this curved surface be a curve L_end, and let an intersection thereof with the suction surface of the vane profile portion 12 be point C. In addition, let an intersection with the pressure surface be point D. The curve L_end gently extends from the intersection C to the intersection D. The curve L_end is the same in radial position. Radial positions of the intersections C, D and a shape of the curve L_end are optimized by selection based on aerodynamic design conditions of the turbine to be designed.

The radial position of the curve L_end is the same in the vicinity of the turbine casing-side end wall portion near the leading edge 12*a* of FIG. 10, but this does not mean that the conditions under which the particular radial position is maintained are set over an entire region. If the conditions that maintain the radial position are set over the entire region, an impulse wave will occur that significantly affects an increase in total pressure loss of the turbine vane. Conditions concerning a pressure ratio between an entrance and exit of the vane will then be limited, which will in turn deteriorate turbine vane performance.

Figure 11:
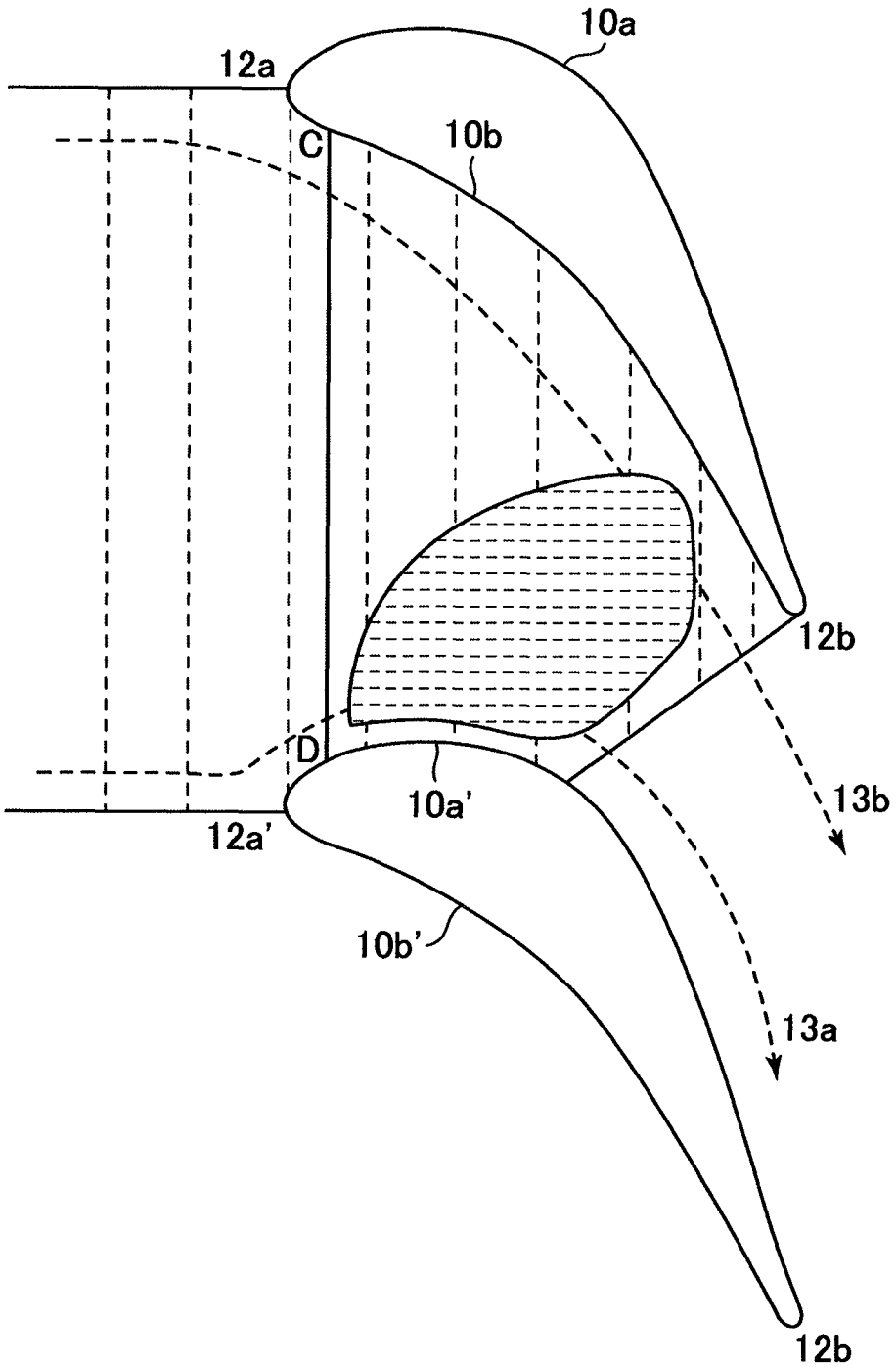
FIG. 11 shows an outer surface of an inner-circumferential end wall portion when viewed from an outer circumferential side.

The inner-circumferential end wall outer surface 16 as viewed from the outer circumferential side is shown in FIG. 11. A region denoted by vertically dashed lines is formed to be high in radial position, and a region denoted by shading with horizontally dashed lines is formed to be small in radial position. Reference number 13*a* denotes a flow of fluid at the suction side of the end wall portion, and reference number 13*b* denotes a flow of fluid at the pressure surface side of the end wall portion. In this case, in the flow direction 13*a* at the suction surface side of the inner-circumferential end wall outer surface, the shape of the vane profile portion changes from the region of the convexed shape that faces in the direction that the rotor 1 increases in radial position at a neighboring portion of the leading edge, to the region of the convexed shape that faces in the direction that the radial position decreases. In the flow direction 13*b* at the pressure surface side, the shape of the vane profile portion changes from the region of the convexed shape that faces in the direction that the radial position increases at the neighboring portion of the leading edge, to the region of the convexed shape that faces in the direction that the radial position decreases. It is to be noted that whereas the concave surface and the convex surface are not paired at the pressure surface side and suction side of the end wall portion, in the flow direction the concave surface and the convex surface are paired at both of the suction side and the pressure surface side.

Figure 13:
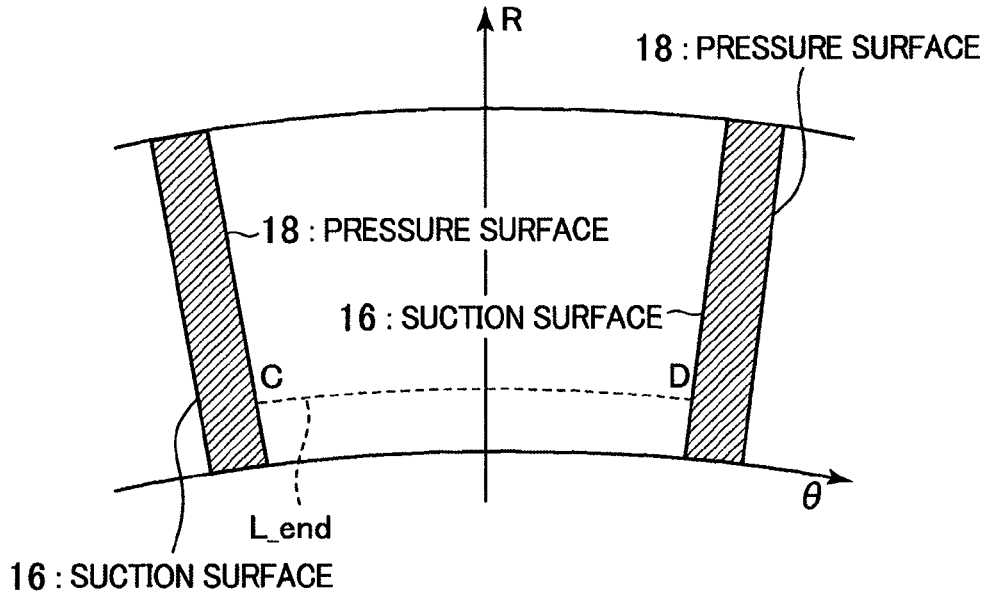
FIG. 13 is a sectional view of a curved surface forming the inner-circumferential end wall portion positioned near the leading edge 12*a*, the curved surface being viewed when imaginarily cut along the plane perpendicular to the rotating shaft of the turbine.

FIG. 13 is a sectional view of a curved surface forming the inner-circumferential end wall portion positioned near the leading edge 12*a* of FIG. 11, the curved surface being viewed when imaginarily cut along the plane perpendicular to the rotating shaft of the turbine. Let a cross section of this curved surface be a curve L_end, and let an intersection thereof with the suction surface of the vane profile portion be point C. In addition, let an intersection with the pressure surface be point D. The curve L_end gently extends from the intersection C to the intersection D. The curve L_end is the same in radial position. Radial positions of the intersections C, D and an upper-surface shape/contour of the curve L_end are optimized by selection based on aerodynamic design conditions of the turbine to be designed.

The radial position of the curve L_end is the same in the vicinity of the inner-circumferential end wall outer surface 16 near the leading edge 12*a* of FIG. 10, but this does not mean that the conditions under which the particular radial position is maintained are set over an entire region. If the conditions that maintain the radial position are set over the entire region, an impulse wave will occur that significantly affects an increase in total pressure loss of the turbine vane. Conditions concerning the pressure ratio between the entrance and exit of the vane will then be limited, which will in turn deteriorate turbine vane performance.

Figure 14:
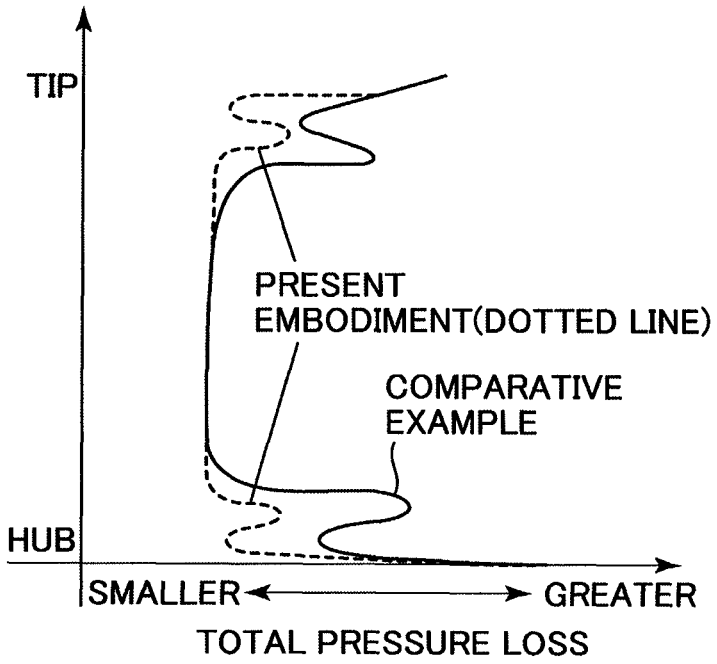
FIG. 14 is an explanatory diagram showing a distribution of total pressure loss at the turbine stator vane.

FIG. 14 shows a distribution of the vane-sectional total pressure loss observed in a vertical direction of the vane profile portion. This distribution in FIG. 14 is shown for comparison between the above-described embodiment and a comparative example not having local concave or convex portions on end wall surfaces. In the comparative example, as shown by a solid line, particularly significant vane-sectional total pressure loss at the end walls is observed, whereas in the present embodiment, as shown by a discontinuous line, the total pressure loss at the vane cross sections of the inner-circumferential end wall and the end wall close to the turbine casing is reduced and uniformity of the total pressure loss at the substantially entire vane profile portion from top to bottom is achieved. This means that more equal expansion work is achieved over an entire vertical region of the vane profile portion, hence that turbine efficiency improves, and that fuel consumption in the gas turbine is correspondingly reduced.

What is claimed is:

1. A gas turbine stator vane, comprising:

a vane profile portion having a pressure surface concaved to a chord line of the vane, and a suction surface convexed to the chord line of the vane;

an outer-circumferential end wall positioned at an outer circumferential side of the vane profile portion; and an inner-circumferential end wall positioned at an inner circumferential side of the vane profile portion; wherein:

an inner surface of the outer-circumferential end wall has an inward convexed shape and an outward convexed shape, at a suction-surface side of the vane profile portion, a vertex of the inward convexed shape is positioned in a neighborhood of a leading edge of the vane profile portion, and a vertex of the outward convexed shape is positioned in a neighborhood of an intermediate region between the leading edge of the vane profile portion and a trailing edge thereof, an upstream end, in a direction of gas flow, of the inward convexed shape is positioned upstream of the leading edge, a line segment where radial positions of the inner surface of the outer-circumferential end wall at a cross section perpendicular to a rotating shaft of a turbine for the gas turbine stator vane are kept a constant value is positioned on the inward convexed shape of the outer-circumferential end wall inner surface, an area of the inward convexed shape of the outer-circumferential end wall inner surface in an axial direction of the turbine, starting upstream of the leading edge and ending downstream of the leading edge, having only the inward convexed shape and no outward convexed shapes, and a region where the outward convexed shape is formed has an area where the radial positions of the inner surface of the outer-circumferential end wall at a cross section perpendicular to the rotating shaft of the turbine are not kept a constant value.

2. A gas turbine stator vane, comprising:

a vane profile portion including a pressure surface of a shape concaved to a chord line of the vane, and a suction surface of a shape convexed to the chord line of the vane;

an outer-circumferential end wall positioned at an outer circumferential side of the vane profile portion; and an inner-circumferential end wall positioned at an inner circumferential side of the vane profile portion; wherein:

an outer surface of the inner-circumferential end wall that is an outer circumferential surface of the inner-circumferential end wall has an outward convexed shape and an inward convexed shape, at a suction-surface side of the vane profile portion, a vertex of the outward convexed shape is positioned in a neighborhood of a leading edge of the vane profile portion, and a vertex of the inward convexed shape is positioned in a neighborhood of an intermediate region between the leading edge of the vane profile portion and a trailing edge thereof, an upstream end, in a direction of gas flow, of the outward convexed shape is positioned upstream of the leading edge, a line segment where radial positions of the outer surface of the inner-circumferential end wall at a cross section perpendicular to a rotating shaft of a turbine for the gas turbine stator vane are kept a constant value is positioned on the outward convexed shape of the inner-circumferential end wall outer surface, an area of the outward convexed shape of the inner-circumferential end wall outer surface in an axial direction of the turbine, starting upstream of the leading edge and ending downstream of the leading edge, having only the outward convexed shape and no inward convexed shapes, and a region where the inward convexed shape is formed has an area where the radial positions of the outer surface of the inner-circumferential end wall at a cross section perpendicular to the rotating shaft of the turbine are not kept a constant value.

3. The gas turbine stator vane according to claim 1, wherein:

an outer surface of the inner-circumferential end wall that is an outer circumferential surface of the inner-circumferential end wall has an outward convexed shape and an inward convexed shape, at the suction surface side of the vane profile portion;

a vertex of an outward convexed shape on the outer surface of the inner-circumferential end wall is positioned in the neighborhood of the leading edge of the vane profile portion; and a vertex of an inward convexed shape on the outer surface of the inner-circumferential end wall is positioned in the neighborhood of the intermediate region between the leading edge and the trailing edge of the vane profile portion.

4. The gas turbine stator vane according to claim 3, wherein:

if a contact point between the end wall and the leading edge of the vane profile portion is represented as existing at a position of 0%, and also a contact point between the end wall and the trailing edge of the vane profile portion is represented as existing at a position of 100% on a straight line passing through the two contact points, then the neighborhood of the leading edge is defined by a range of less than or equal to 40% of the straight line.

5. The gas turbine stator vane according to claim 3, wherein:

if a contact point between the end wall and the leading edge of the vane profile portion is represented as existing at a position of 0%, and also a contact point between the end wall and the trailing edge of the vane profile portion is represented as existing at a position of 100% on a straight line passing through the two contact points, then the neighborhood of the intermediate region is defined by a range from 30% to 80% of the straight line.

* * * * *